US005086931A

United States Patent [19]

Cobb

[11] Patent Number: 5,086,931

[45] Date of Patent: Feb. 11, 1992

[54] DEVICE FOR HOLDING STACKED CAPS

[76] Inventor: Denis Cobb, 11529 S. Norlain Ave., Downey, Calif. 90241

[21] Appl. No.: 575,557

[22] Filed: Aug. 30, 1990

Related U.S. Application Data

[63] Continuation-in-part of Ser. No. 508,006, Apr. 10, 1990, abandoned.

[51] Int. Cl.[5] ..... A47F 7/00

[52] U.S. Cl. ..... 211/32; 211/88

[58] Field of Search ..... 211/32, 30, 31, 88, 211/33; 206/8; 2/195

[56] References Cited

U.S. PATENT DOCUMENTS

| | | | |
|---|---|---|---|
| 447,278 | 2/1891 | Cooper . | |
| 770,835 | 9/1904 | Tubman . | |
| 1,705,557 | 3/1929 | Chow . | |
| 1,799,395 | 4/1931 | Shoer | 211/32 X |
| 2,494,487 | 1/1950 | Pfeil . | |
| 2,626,712 | 1/1953 | Frush . | |
| 2,633,246 | 3/1953 | Guthrie | 211/32 |
| 2,761,644 | 9/1956 | Capocci | 211/32 X |
| 2,783,895 | 3/1957 | Lynch . | |
| 2,937,759 | 5/1960 | Smith . | |
| 3,178,030 | 4/1965 | Huebel . | |
| 4,817,900 | 4/1989 | Whittington et al. . | |
| 4,869,378 | 9/1989 | Miller . | |

FOREIGN PATENT DOCUMENTS

| | | | |
|---|---|---|---|
| 748822 | 7/1933 | France . | |
| 265320 | 2/1927 | United Kingdom | 211/32 |
| 432162 | 7/1935 | United Kingdom . | |

*Primary Examiner*—Reinaldo P. Machado
*Assistant Examiner*—Sarah A. Lechok
*Attorney, Agent, or Firm*—Christie, Parker & Hale

[57] ABSTRACT

A device for supporting a plurality of stacked caps has a concave upward element with two end portions defining mounting brackets for attachment to a wall. In one embodiment the brackets have screw holes, and in another embodiment the brackets have elongate tabs which fit into a channel defined in the wall. The device is so mounted to the wall that the concave portion faces upward and supports the front part of the crown of a lowermost one of the caps. The visor of the lowermost one of the caps is positioned in a gap defined between the concave element and the wall and faces downward. A next one of the caps is supported by a rear portion of the crown of the lowermost cap and also has its visor located in the gap. Additional caps are stacked in the same manner. The concave element inclines upwardly away from the wall to help support the stacked caps. In a further embodiment, the device stores in a planar shape, and the end portions are rotatable 90° with respect to the concave upward element for purposes of mounting to the wall. In an additional embodiment, the device has a clip located below the concave upward element for supporting and displaying one cap.

16 Claims, 10 Drawing Sheets

DEVICE FOR HOLDING STACKED CAPS

This is a continuation-in-part of Ser. No. 07/508,006, filed Apr. 10, 1990 now abandoned.

BACKGROUND OF THE INVENTION

The present invention relates to a device for holding stacked caps, and in particular, to a wall-mountable unitary element for vertically stacking baseball-style caps.

In the past, devices for holding individual hats or caps have been used. One example is a hat rack which has a hook for holding one hat by engaging an inner surface of the rear part of the crown of the hat. Baseball-style caps, in particular, are difficult to stack inasmuch as they are lightweight and pliable. If stacked vertically on a surface, the stack is relatively easily knocked over. Proposed devices for holding caps include horizontally-oriented poles with individual hooks along their length, each hook being adapted for holding one cap, or horizontally-oriented poles having some other mechanism for holding individual caps by the button located at the top of the crown. These devices take up quite a bit of horizontal space. Therefore, it is desirable to stack caps vertically yet securely.

SUMMARY OF THE INVENTION

The invention is a device for holding stacked baseball-style caps, the device being mountable on a wall or other surface.

In a preferred embodiment, the device has a concave upward member with mounting brackets integrally formed at each end. The brackets have a heel portion below where they are fastened to a wall by screws. In another embodiment, the brackets have an elongate tab which fits into a corresponding slot formed in the wall.

The concave member is shaped to define a space between it and the wall. The caps mount onto the device with their visor portions in the space and facing downward. The front of the crown of a lowermost one of the caps rests on a concave upward crown supporting member. The rear of the crown is folded into the front of the crown, so that a next lowest cap stacks on this lowermost cap, and so on. The crown supporting member also inclines upwardly in a direction away from the mounting brackets. When many caps are stacked, any tipping movement due to the weight of the caps is counteracted by the fixed tilt of the supporting member. In addition, the crown supporting surface has a width which is sufficient to contact and support a substantial portion of the crown of the lowermost cap, to provide further support against tipping of the caps.

In another embodiment, the mounting brackets are unitary with or otherwise attached to the supporting member so as to be pivotable with respect to this supporting member. This structure enables the brackets and supporting member to initially have a flattened shape for packaging, then assume the curved and tilted shape when the brackets are mounted to a wall.

In a further embodiment, a hook attaches to the underside of the supporting member for displaying one of the caps.

These elements and advantages of the invention, as well as further elements and advantages of the invention, will become more evident upon reading the detailed description and claims in conjunction with the drawings.

DETAILED DESCRIPTION OF THE PREFERRED EMBODIMENTS

Figure 1:
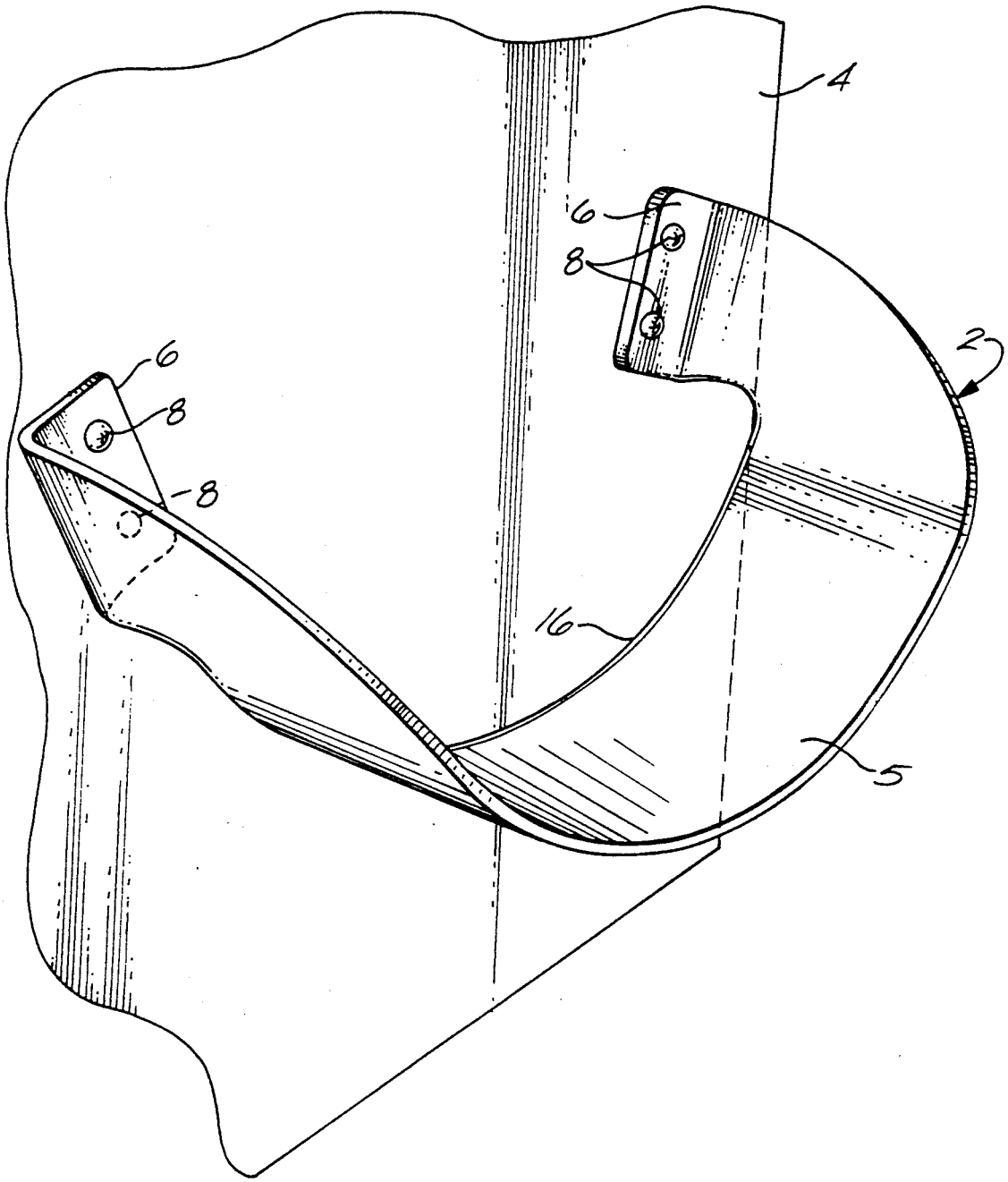
FIG. 1 is a front perspective view of a first embodiment of a device for holding stacked caps according to the invention.
Figure 2:
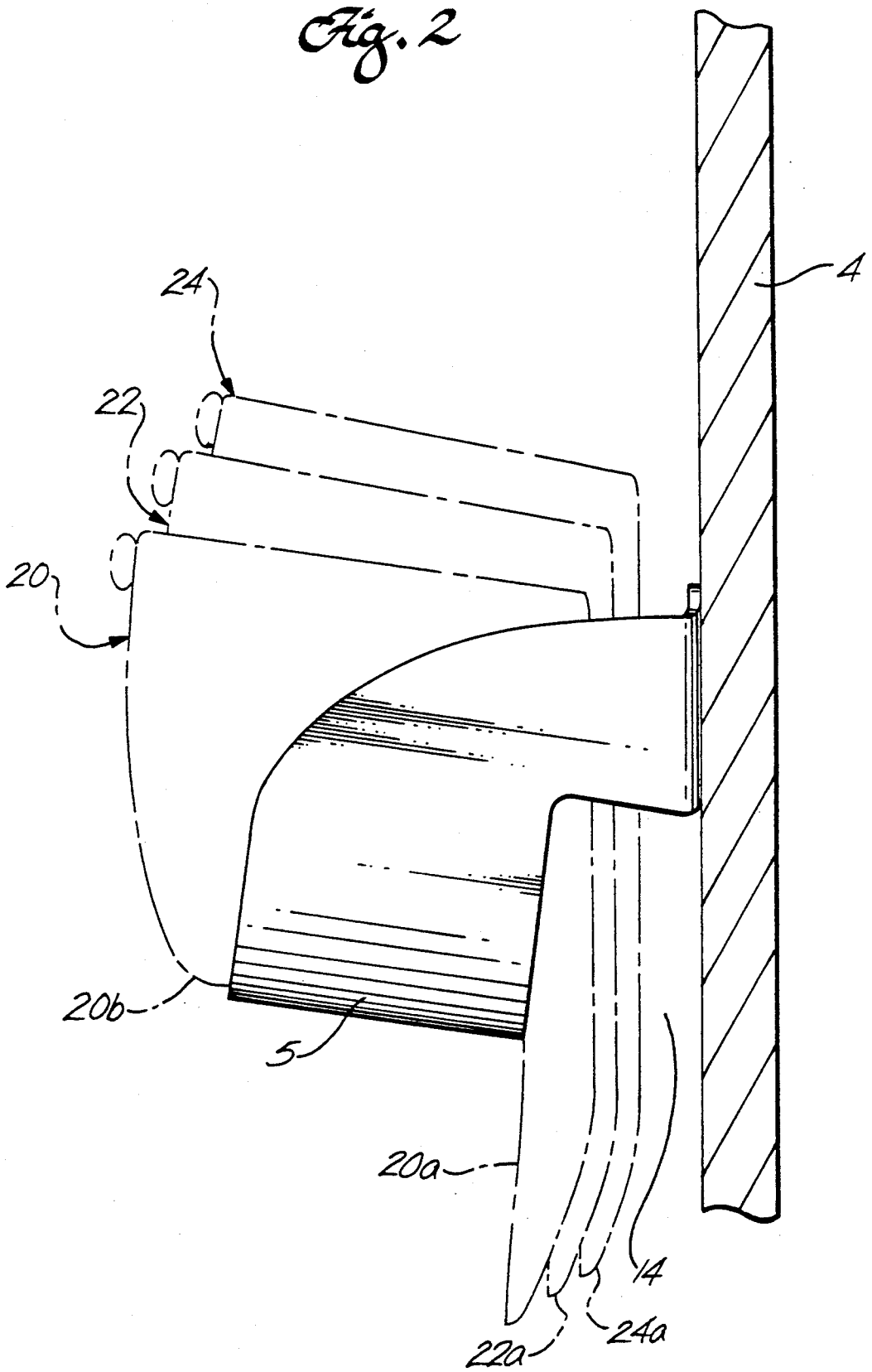
FIG. 2 is a side view of the device of FIG. 1, with multiple caps shown in phantom.
Figure 3:
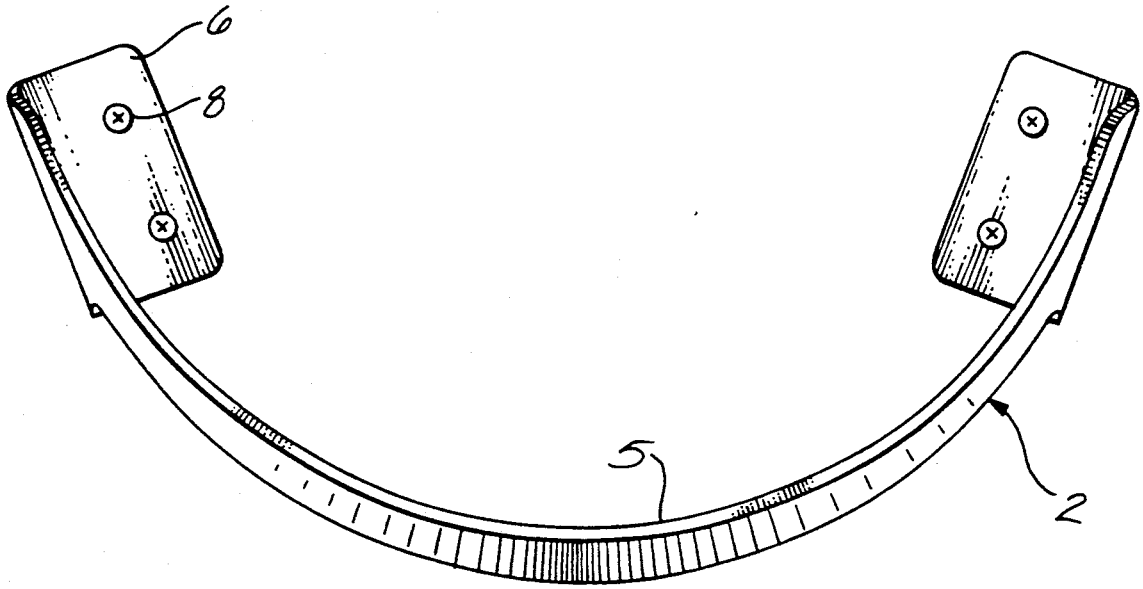
FIG. 3 is a front view of the device.

A device for holding caps according to a first embodiment of the invention is shown in FIGS. 1-3.

FIG. shows a perspective view of the device 2 mounted to a surface 4, such as a wall. As used herein, wall refers to any suitable mounting surface. FIG. 2 is a side view of the device, and FIG. 3 is a front view thereof without the wall. Device 2 is preferably made up of a single symmetrical plastic member. If plastic, it may be made by injection molding, forming a plastic plate into the desired device, or other suitable processes. The member has a concave upward portion 5 and mounting brackets 6 located at each end of portion 5. The brackets preferably are unitary with the portion 5 and have holes for receiving screws 8 to attach device 2 to wall 4. The device is shaped such that there is a gap 14 (FIG. 2) between an inner edge 16 of the member and the wall 4.

With continued reference to FIG. 2, a plurality of baseball-style caps 20, 22 and 24 are supported by device 2 with their visors 20*a*, 22*a*, 24*a* positioned in gap 14 and facing downward. The lowermost cap 20 is supported at a front surface of its crown 20*b* by concave upward portion 5 of device 2. Portion 5 is relatively wide so as to contact substantially all of the front of the crown. Portion 5 also inclines upwardly away from wall 4 to help hold cap 20, and the other caps, in position. The rear of crown 20*b* of cap 20 folds into the front part of the crown, so that the next cap 22 is supported by cap 20. Cap 22 folds up in the same way as cap 20, so that cap 24 is supported by cap 22. Additional caps are also stacked this way. The base of the topmost cap 24 will often contact wall 4 for additional support.

The stacked caps have a tendency to rotate away from the wall and thus fall off the cap holding device, due to the weight of the crowns as compared to the visor portions of the caps. The upward incline of the crown supporting member, i.e., concave portion 5, is important to offset any moment of the stacked caps which might otherwise cause them to fall. Moreover, the width of portion 5 is preferably such that it contacts substantially all of the front of the crown of the lowermost cap, and thus minimizes the possibility that it will serve as a fulcrum for the stacked caps to rotate on. That is, the width of the portion 5 thus helps ensure that at least some of portion 5 will be further away from the wall than the center of gravity of the stacked caps, yet the caps will not be able to fall through the gap 14 between the wall and the portion 5.

Moreover, to provide secure support to the caps, the portion 5 is relatively rigid, as shown, e.g., in FIG. 2. That is, the material out of which the device, including portion 5 and its connection to wall 4 via brackets 6, is made must be sufficiently rigid to avoid deforming too much under the weight of the stacked caps, otherwise the portion 5 will move away from the wall and the caps can fall through the gap or the portion 5 will move toward the wall and the caps will topple.

Figure 4:
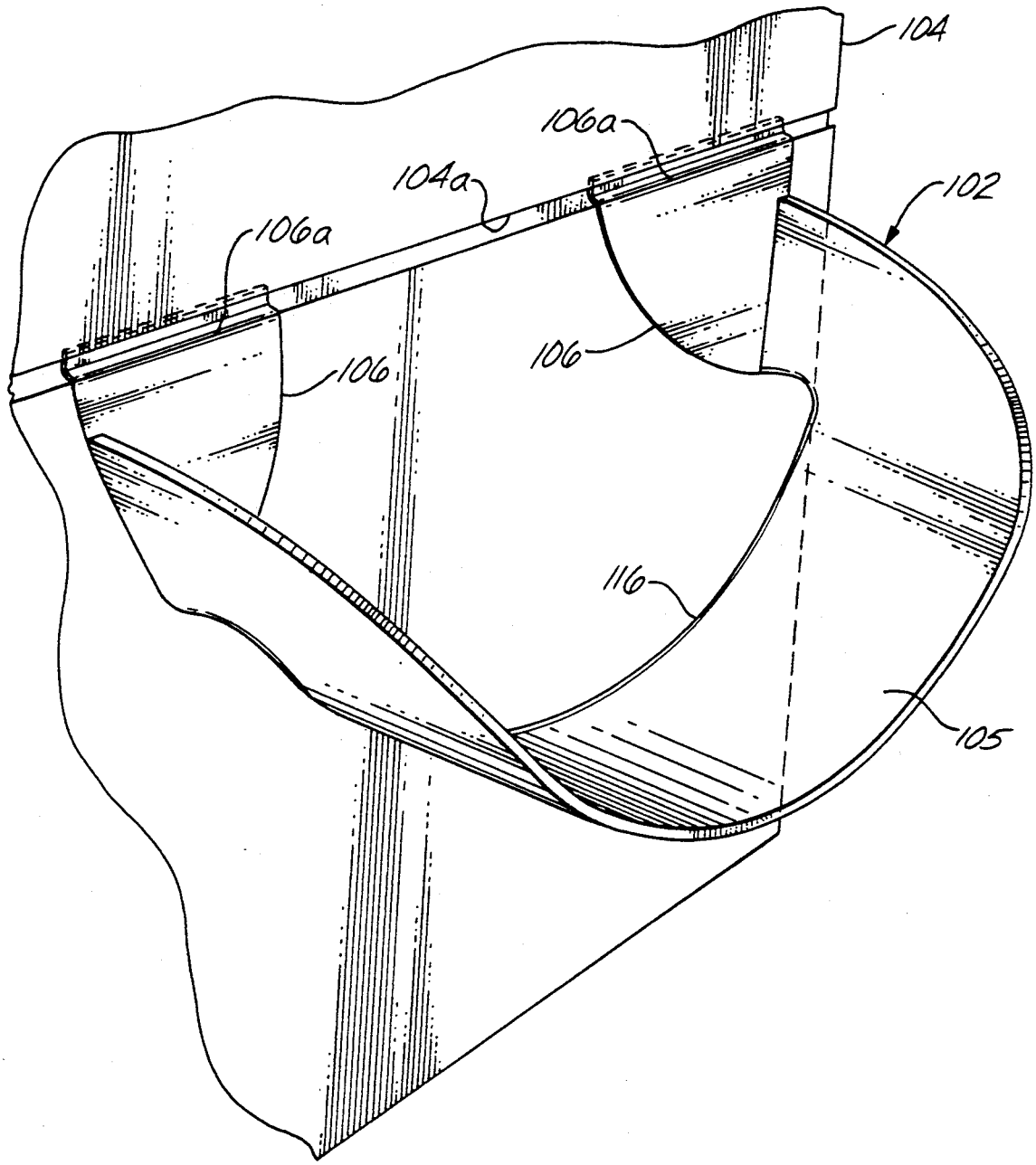
FIG. 4 is a front perspective view of a second embodiment ,of the device.
Figure 5:
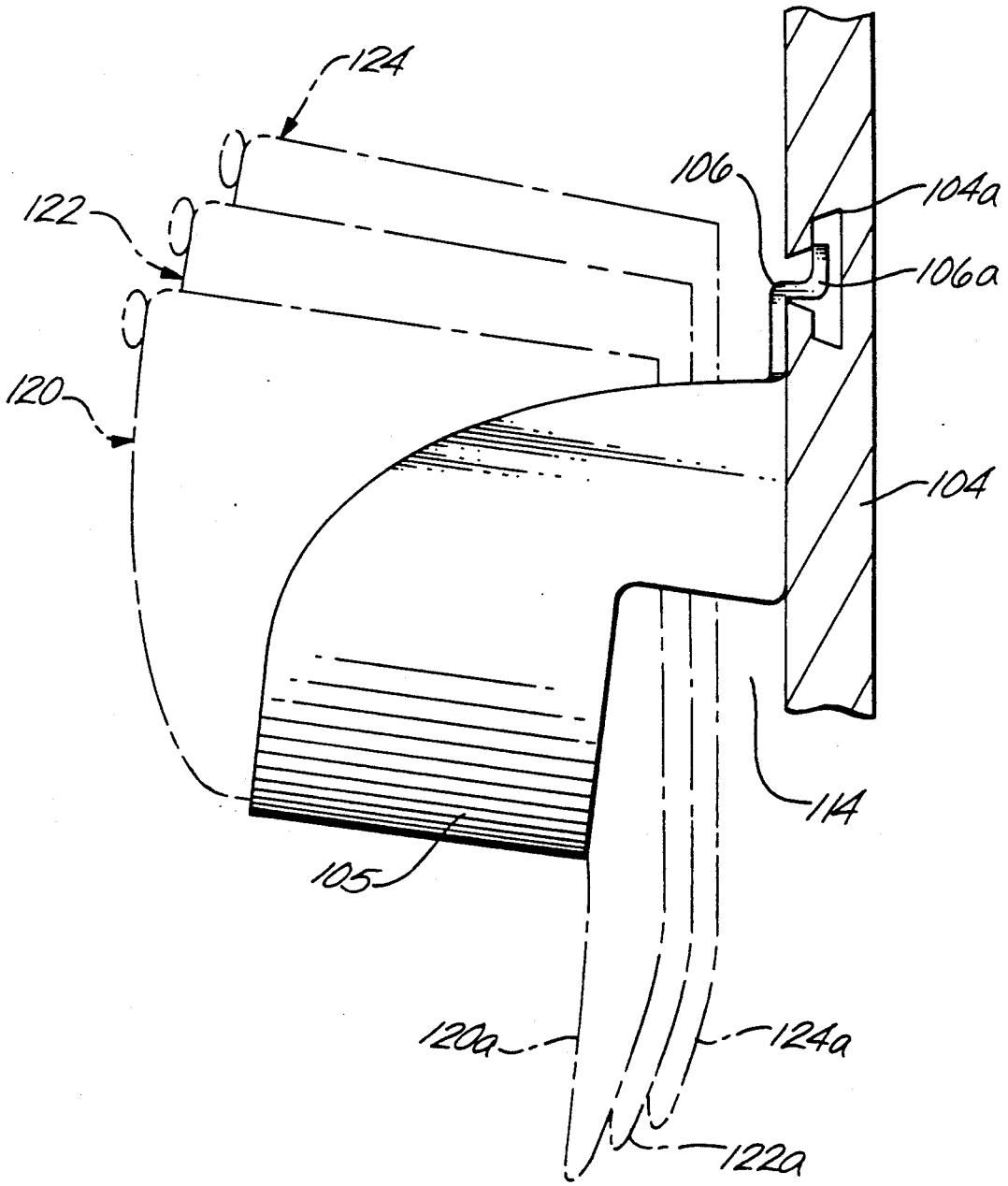
FIG. 5 is a side view of the device of FIG. 4, with multiple caps shown in phantom.
Figure 6:
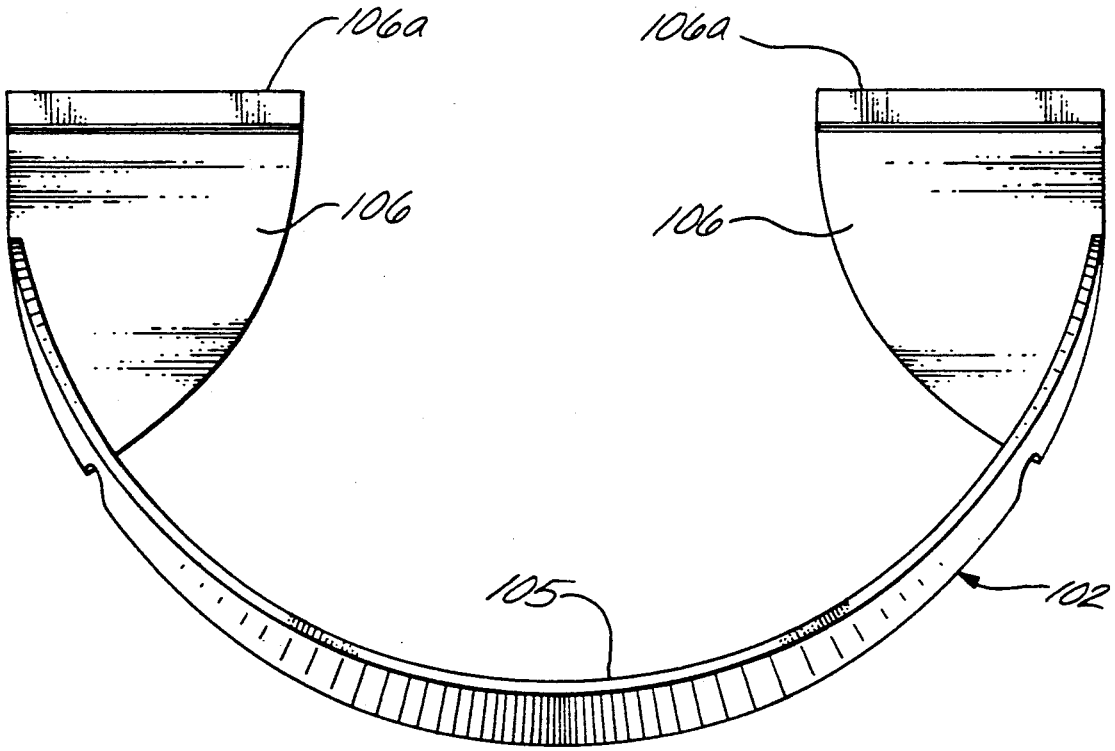
FIG. 6 is a front view of the device of FIG. 4.

FIGS. 4–6 show a second embodiment of the inventive device. FIG. 4 is a front perspective view of device 102 having a preferably unitary symmetrical plastic member for mounting to a wall 104 with a channel 104a or channels, e.g., a so-called "channel wall." The unitary member has a concave upward portion 105, which is substantially the same as that in the first embodiment, and has integral wall-mounting brackets 106 at each end. Brackets 106 have elongate tabs 106*a* that fit into channel 104*a* formed in wall 104, as best shown in FIG. 5. The unitary member defines a space 114 between its inner edge 116 and wall 104.

FIG. 5 also shows three caps 120, 122, 124 stacked in the device. Visors 120*a*, 122*a*, 124*a* of the caps are positioned in gap 114 and face downward. The device of this embodiment functions substantially the same as the device of the first embodiment.

Figure 7:
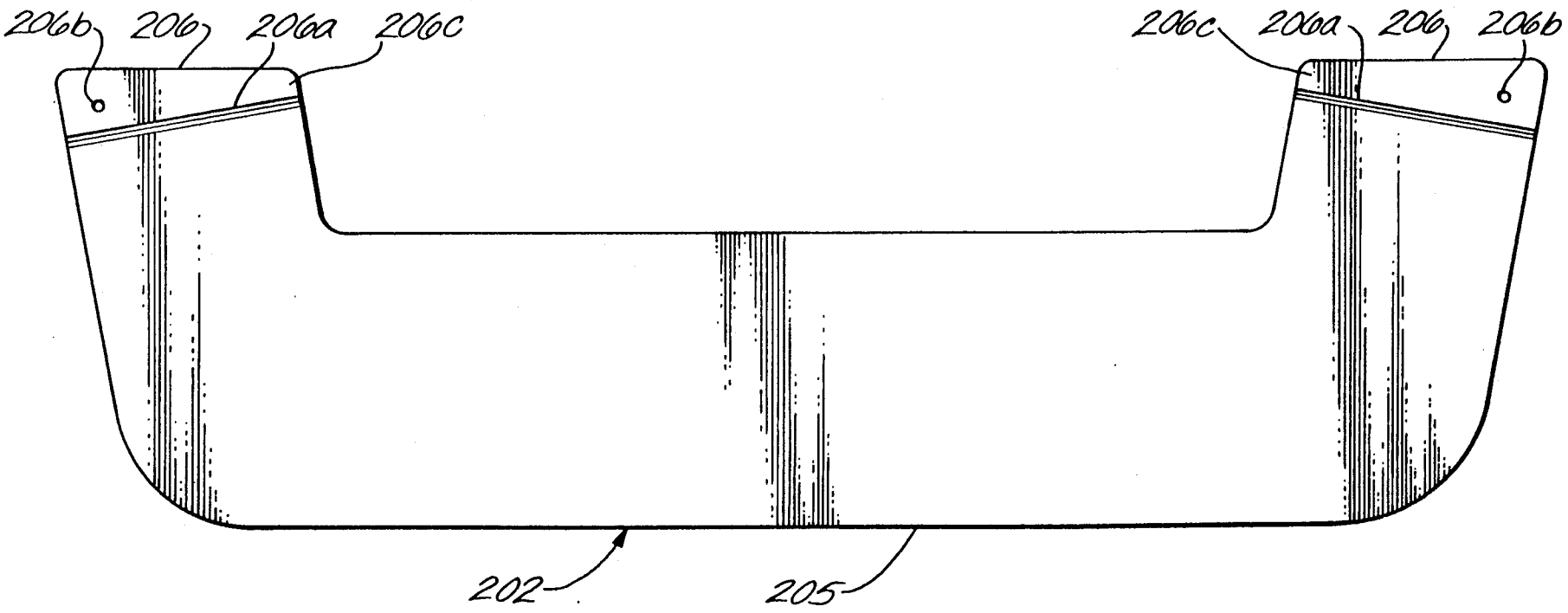
FIG. 7 is a top view of a third embodiment of the device in a flattened state for packaging.
Figure 8:
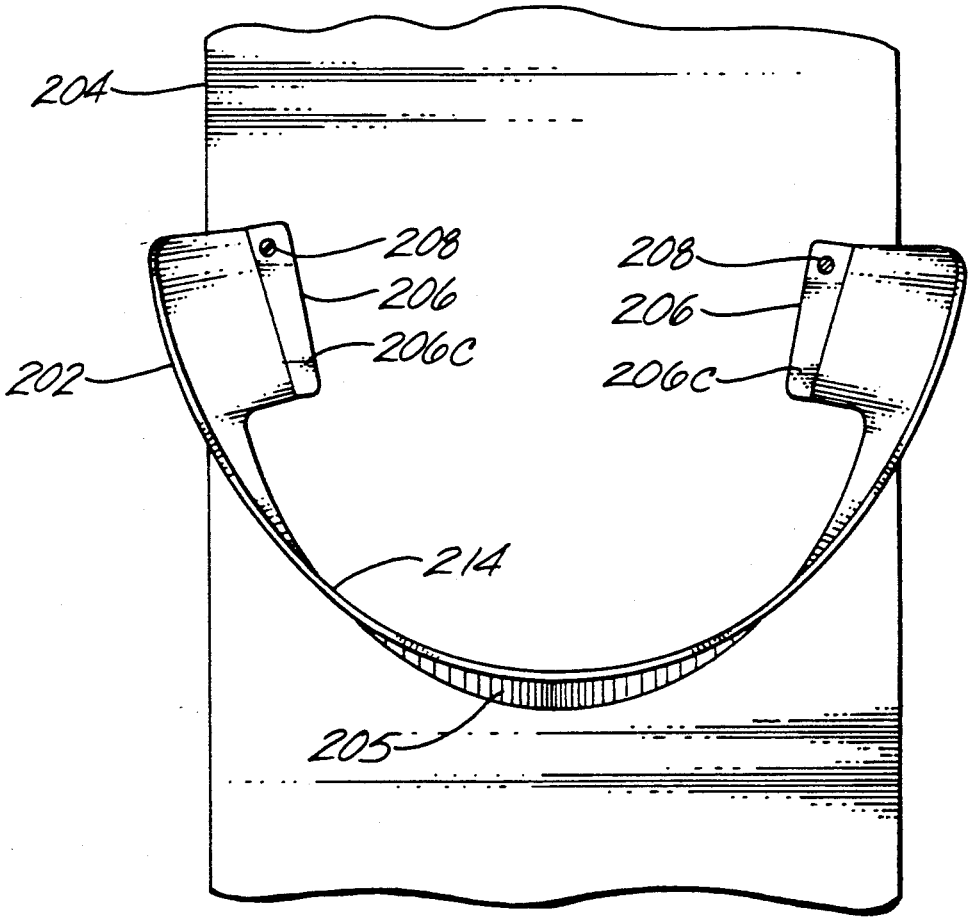
FIG. 8 is a front view of the device of FIG. 7.

FIGS. 7 and 8 show a third embodiment of the invention in which a device 202 stores in a planar orientation for purposes of packaging, yet readily assumes its curved shape when mounted to the wall. For this embodiment, the device is preferably made of vinyl or other material which is biased into a flat orientation while being sufficiently flexible to curve when mounted to a wall, and sufficiently rigid so as not to substantially deform once mounted to the wall and subject to the load of stacked caps.

In this embodiment, device 202 has a crown supporting member 205 unitary with (or attached to) bracket portions 206 defined by two pivot axes such as creases or shallow channels 206*a* formed in the device. To mount the device to wall 204, one pivots the brackets 206 about the creases 206*a* and bends the supporting member 205 such that the brackets are at 90. and the member assumes its curved shape and thus is mountable to the wall. In this position, the supporting member 205 will be spaced from wall 204 so as to form a gap 214 and will incline upwardly away from the wall. Brackets 206 attach to the wall by any suitable means, such as a screw 208 through a hole in the upper part of each bracket. The lower part of each braket forms a heel 206*c* which helps offset the natural moment of multiple caps stacked on the device. The distance between the screw attachment points should be such that typical cap visors fit in gap 214, e.g., 8½". A template (not shown) showing the outline of the device and/or the proper screw hole positioning may be used to assist in mounting.

Figure 9:
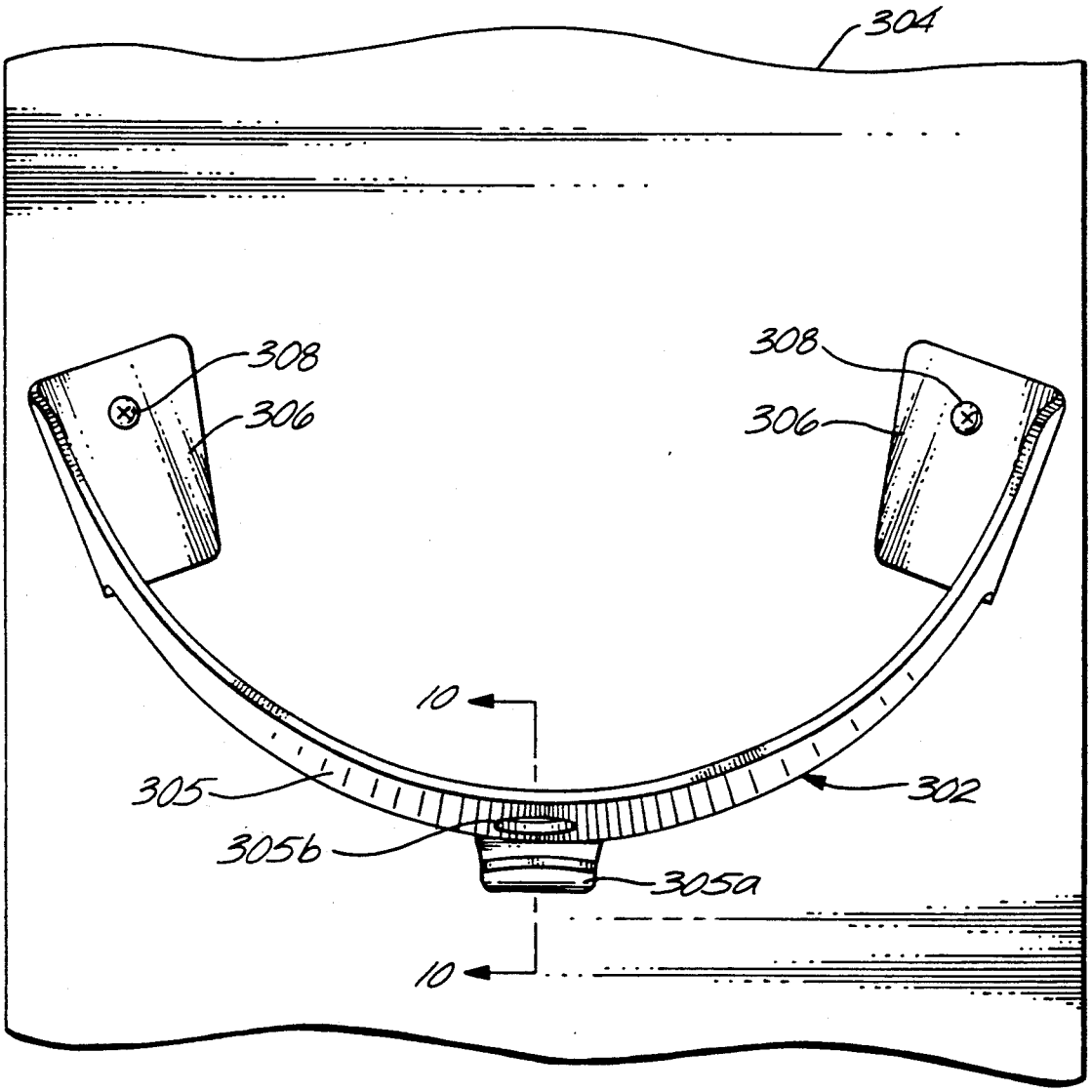
FIG. 9 is a front view of a fourth embodiment of the device.
Figure 10:
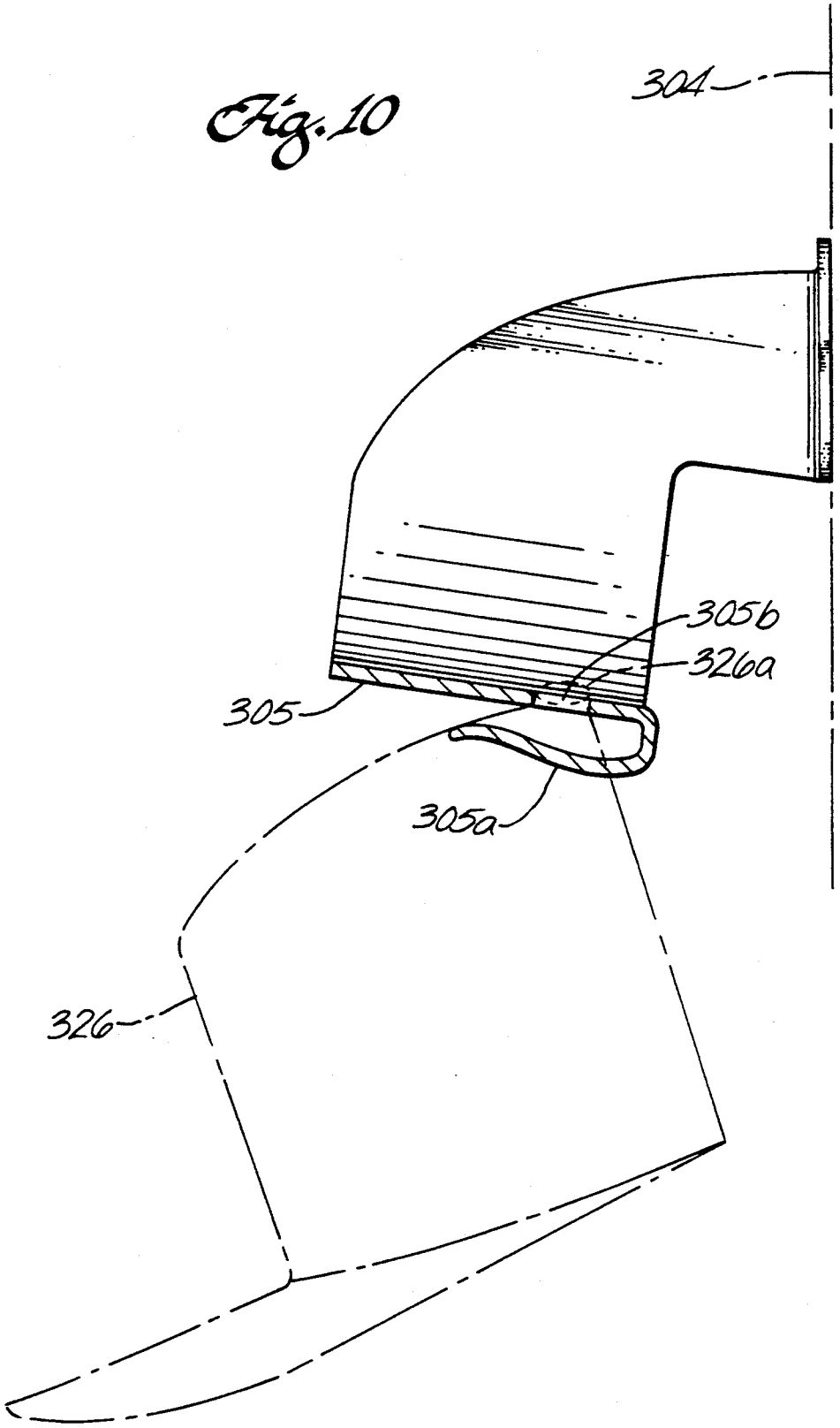
FIG. 10 is a vertical sectional view of the device of FIG. 9 along line 10—10 of FIG. 9, and showing a cap in phantom.

A fourth embodiment of the invention is shown in FIGS. 9 and 10. Device 302 of this embodiment is similar to that of FIG. 1 except that device 302 has a supporting member 305 with a clip or hook 305*a* attached or unitary therewith and positioned for holding a cap 326 just below member 305. Hook 305*a* has an upward incline and then declines away from wall 304. Preferably, hook 305*a* has some resiliency and member 305 has a small hole 305*b* located above hook 305*a* such that the button 326*a* of cap 326 is biased into the hole. Thus, cap 326 easily slides onto and stays in place on hook 305*a*, and is easily removable from hook 305*a* by pressing down on the hook. As in the previous embodiments, device 302 may be mounted to wall 304 by screws 308 through brackets 306. However, this embodiment, unlike the previous embodiments, allows a cap to be displayed, such as in a store, so a customer can see the type of cap (e.g., the team) even though the type is not readily visible for those caps that are stacked.

In all embodiments of the invention, the structural integrity or relative rigidity of the device when mounted (i.e., from the points of connection to the wall, through the heel of the mounting brackets and to the crown supporting member, the incline of the supporting member, and the width of the supporting member being sufficiently large to contact substantially all of the front of the crown of the lowermost cap) achieves a device which can support numerous stacked caps.

The disclosed embodiments are illustrative of the invention. They are not intended to limit the invention. Rather, the invention is defined in the appended claims. Numerous variations of the disclosed embodiments will be evident to one of ordinary skill in the art, which variations would fall within the scope of the claims. For example, the angle of incline of the concave portion away from the wall, the width of the concave portion, and the sides of the gap should be set to avoid a cap or caps falling through the gap. The number of caps in the stack to some extent depends on these variables, and could be quite numerous, even as many as ten or twenty or more. The device need not mount to a wall, but can mount to other preferably flat surfaces, such as on a door. The mounting brackets need not be unitary with the concave upward portion, but could otherwise be attached to it.

The device need not be plastic. Numerous other materials such as acrylic, PETG, lexan, wood and metal would be suitable. The device also need not be solid. It could be made of a mesh-like material such as a wire mesh. The concave upward portion is not limited to the exact shape shown.

What is claimed is:

1. A device mountable to a wall for supporting a plurality of stacked caps, comprising:

a concave portion for vertically supporting a crown of a lowermost one of the stacked caps;

two end portions connected to the concave portion for mounting the device to the wall, the concave portion being so shaped and disposed as to define a gap between it and the wall for receiving visors of the stacked caps, wherein the lowermost cap is supported so as to be adapted for supporting a crown of a next one of the stacked caps;

wherein the concave portion has a width in a direction perpendicular to the wall for contacting and supporting substantially all of the front of the crown of the lowermost one of the stacked caps; and wherein the width of the concave portion is inclined upwardly away from the wall.

2. The device of claim 1 wherein each of the end portions has holes for being mounted to the wall by screws.

3. The device of claim 1 wherein each of the end portions has an elongate tab adapted for fitting into a channel formed in the wall.

4. The device of claim 1 wherein the two end portions are unitary with the concave portion.

5. A device mounted to a wall for supporting a plurality of stacked caps in combination with the stacked caps, the combination comprising:

the stacked caps;

a concave portion for vertically supporting a crown of a lowermost one of the stacked caps;

two end portions connected to the concave portion for mounting the device to the wall, the concave portion being so shaped and disposed as to define a gap between it and the wall for receiving visors of the stacked caps, wherein the lowermost cap is supported such that it supports a crown of a next one of the stacked caps;

wherein the concave portion has a width in a direction perpendicular to the wall for contacting and supporting substantially all of the front of the crown of the lowermost one of the stacked caps; and wherein the width of the concave portion is inclined upwardly away from the wall.

6. The combination of claim 5 wherein each of the end portions has holes for being mounted to the wall by screws.

7. The combination of claim 5 wherein the wall has a channel, and each of the end portions has an elongate tab adapted for fitting into the channel.

8. The combination of claim 5 wherein the two end portions are unitary with the concave portion.

9. The device of claim wherein the concave portion and end portions are rigidly connected to each other and the wall relative to a weight of the stacked caps.

10. The device of claim 5 wherein the concave portion and end portions are rigidly connected to each other and the wall relative to a weight of the stacked caps.

11. The device of claim 1 wherein the two end portions are defined by respective channels formed in the concave portion, the two end portions being pivotable about the channels and with respect to the concave portion, whereby the concave portion and two end portions are adapted for being stored in a planar orientation.

12. The device of claim 5 wherein the two end portions are defined by respective channels formed in the concave portion, and the two end portions are pivotable about the channels and with respect to the concave portion, whereby the concave portion and two end portions are adapted for being stored in a planar orientation.

13. The device of claim 1 further comprising a hook, mounted to and extending below the concave portion, for holding an additional cap such that the front of the crown of the additional cap faces in a direction away from the wall.

14. The device of claim 5 further comprising a hook, mounted to and extending below the concave portion, for holding an additional cap such that the front of the crown of the additional cap faces in a direction away from the wall.

15. The device of claim 13 wherein the concave portion has means defining an aperture therein above the hook for receiving a button of the additional cap, and the hook resiliently biases the button into the hole.

16. The device of claim 14 wherein the concave portion has means defining an aperture therein above the hook for receiving a button of the additional cap, and the hook resiliently biases the button into the hole.

* * * * *